United States Patent [19]

Sole et al.

[11] 4,168,066

[45] Sep. 18, 1979

[54] GLIDING DISC PROJECTILE AND TARGET GAME

[76] Inventors: Herbert Sole, 774 W. Barnes Lake Rd., Columbiaville, Mich. 48421; David E. Treat, 751 E. Elza, Hazel Park, Mich. 48030

[21] Appl. No.: 830,676

[22] Filed: Sep. 6, 1977

[51] Int. Cl.[2] ..... A63B 71/02

[52] U.S. Cl. ..... 273/95 R; 273/102 S

[58] Field of Search ..... 273/95 R, 105 R, 102 R, 273/106 R, 106 B, 102 S

[56] References Cited

U.S. PATENT DOCUMENTS

| | | | |
|---|---|---|---|
| 817,928 | 4/1906 | Medley | 273/105 R X |
| 1,531,614 | 3/1925 | Houston | 273/95 R X |
| 1,598,865 | 9/1926 | Limerick | 273/95 R |
| 1,989,484 | 1/1935 | Maryfield et al. | 273/102 R |
| 2,008,359 | 7/1935 | Lamb | 273/95 R |
| 2,039,782 | 5/1936 | Doty | 273/102 R |
| 3,026,110 | 3/1962 | Hess et al. | 273/102 R X |
| 3,256,021 | 6/1966 | Nissen et al. | 273/95 R |
| 3,596,909 | 8/1971 | Russ | 273/95 R X |
| 3,895,801 | 7/1975 | Baird | 273/95 R |

FOREIGN PATENT DOCUMENTS

| | | | |
|---|---|---|---|
| 1301373 | 7/1962 | France | 273/96 R |

*Primary Examiner*—George J. Marlo

*Attorney, Agent, or Firm*—Basile and Weintraub

[57] ABSTRACT

A game for at least two players wherein one of the players manually propels a disk-shaped projectile so as to glide the projectile through one of at least three hoops positioned in a common plane and mounted between the players such that the projectile may be caught by the other of the players after the projectile has glided through one of the hoops. The support structure for the hoops may include either one or two vertically extending legs, each of which includes L-shaped brackets at its lower end which function to hold the legs in an upright position. The three hoops are so arranged that at least two hoops abut at least one other hoop and the upper end portion of the supporting structure. The hoops are mounted at a predetermined level above the playing surface, and the hoops are of different diameters to provide varying target areas. The hoops are accorded point values that decrease as the areas of the hoops are increased. In the preferred embodiment the object of the game is to score exactly 21 points, with the hoops being provided with varying sized areas having point values of 1, 2 and 3.

5 Claims, 7 Drawing Figures

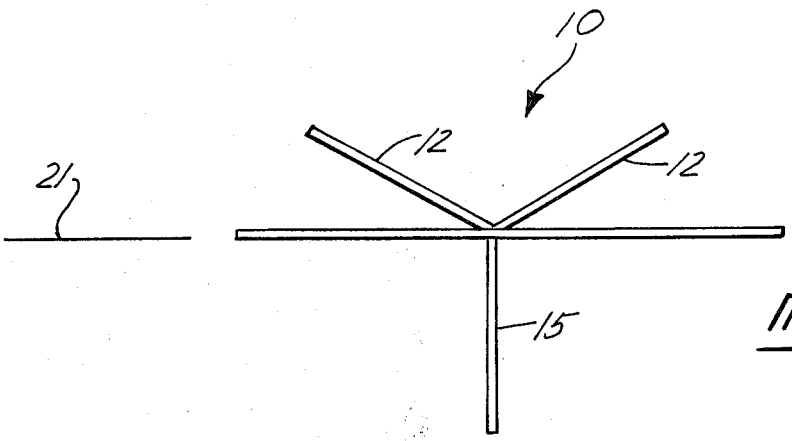
Fig-2
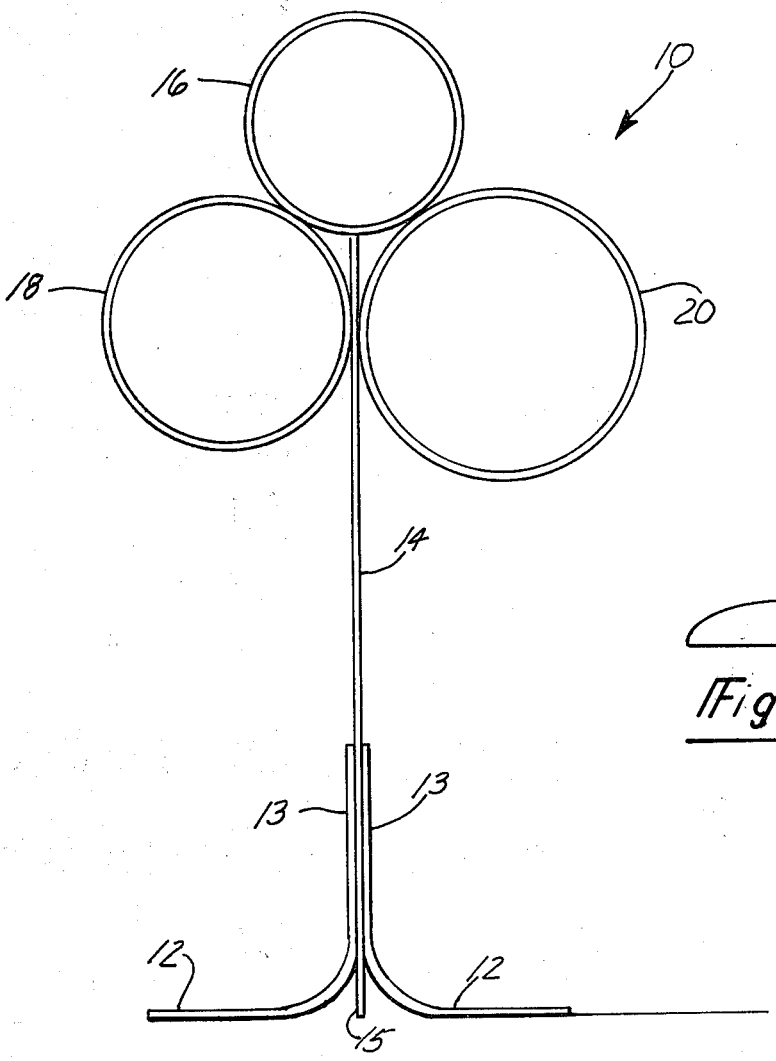
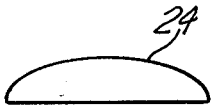
Fig-3
Fig-1

GLIDING DISC PROJECTILE AND TARGET GAME

BACKGROUND OF THE INVENTION

I. Field of the Invention

The present invention relates generally to games and, in particular, to a game which employs a plurality of circular hoops with varying diameters that are mounted between at least two players and wherein one player propels a disk-shaped projectile through one of the hoops so as to be caught by the other player.

II. Description of the Prior Art

There are many well-known games which involve throwing projectiles at targets and testing the accuracy and skill of the participants. Examples of such games are disclosed in U.S. Pat. No. 3,026,110; No. 3,596,909; and No. 3,895,801. Each of these patents employs a disk-shaped projectile which is used by a player to propel the projectile toward a target. In U.S. Pat. No. 3,596,909 the projectile is propelled in such a manner that the same glides outwardly and downwardly toward a playing surface that is disposed on a horizontal surface; and depending upon where the projectile lands on the landing surface, the player is accorded different points. U.S. Pat. No. 3,026,110 is similar in that a projectile is propelled by a player against a vertical target; and depending upon where the disk or disc strikes the vertically disposed target, the player will be accorded a certain number of points. U.S. Pat. No. 3,895,801 discloses a game which is played on a body of water comprising a floating target and projectiles which are skipped across the surface of the water toward the target by the participants of the game wherein the participants receive certain points, depending upon the variety of embodiments disclosed in the patent.

U.S. Pat. No. 2,039,782 discloses a game which employs a plurality of circular apertures through which a projectile is propelled. U.S. Pat. No. 1,989,484 discloses an apertured board adapted to be used for bait casting practice; however, this broadly relates to the reception of a projectile.

While each of the aforementioned patents discloses games and similar structures which are utilized in conjunction with a disk-shaped projectile that is propelled through the air toward the target, none are believed to anticipate applicants' novel invention as described hereinafter.

III. Prior Art Statement

In the opinion of the applicants, the prior art as listed hereinbefore constitutes the closest prior art of which the applicants are aware.

SUMMARY OF THE INVENTION

The present invention, which will be described subsequently in greater detail, comprises a game for at least two players wherein the game comprises a target in the form of a plurality of circular hoops disposed in a common plane and wherein each of the hoops has a different diameter such that each diametered hoop presents a target of a different cross-sectional area. Each circular hoop is accorded a different point value such that when one of the players propel a disk-shaped projectile through one of the hoops and it is caught by the other of the players, the amount of points awarded to the players will be in accordance with the point value of the particular hoop through which the disk passed.

It is therefore a primary object of the present invention to provide a new and improved game which utilizes a plurality of circular hoops as targets for a disk-shaped projectile to provide a highly amusing, interesting and attractive game in which the qualities of skill and judgment play proportionate parts in the operation of the game.

It is a further object of the present invention to provide a game of the type described which may be played by a plurality of persons such that the game may be used in a competitive manner.

Other objects, advantages and applications of the present invention will become apparent to those skilled in the art of games when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a front plan view of a game target constructed in accordance with the principles of the present invention;

FIG. 2 is a top plan view of FIG. 1;

FIG. 3 is a side elevational view of one example of a disk-shaped projectile used in playing the inventive game;

DESCRIPTION OF THE PREFERRED EMBODIMENTS

Figure 4:
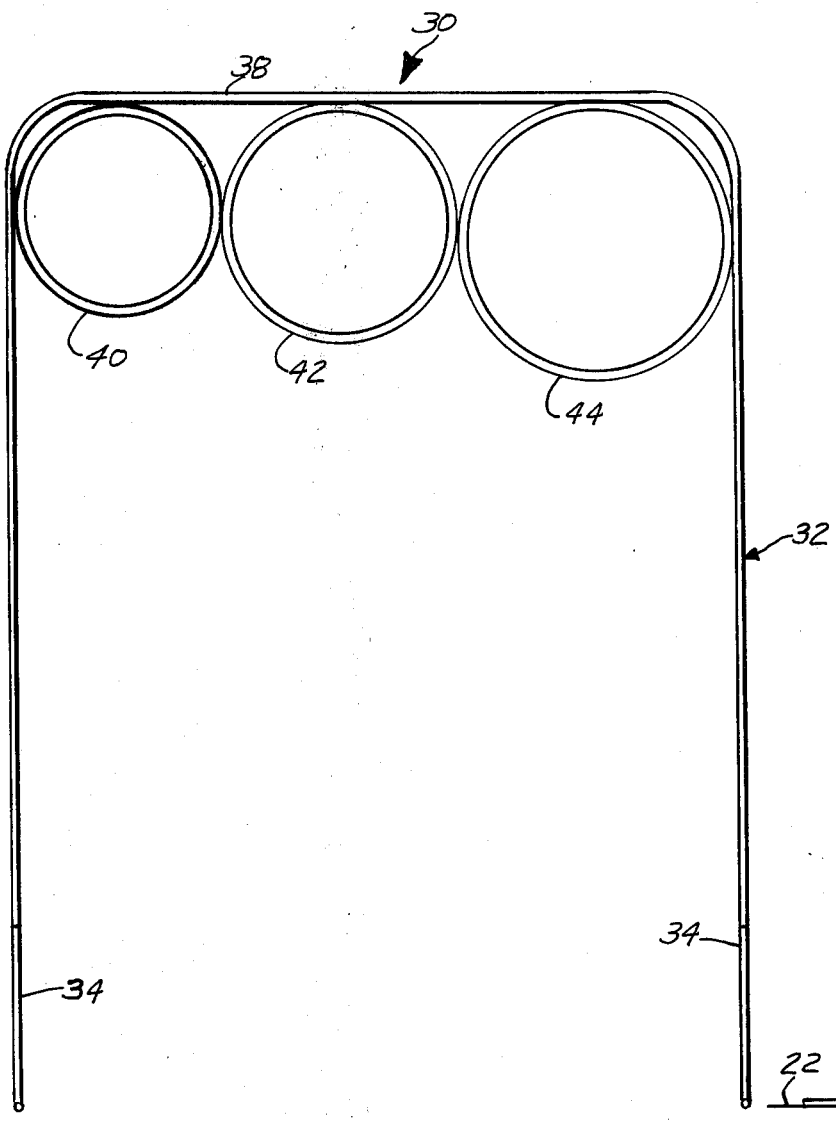
FIG. 4 is a front plan view of a second example of a game target constructed in accordance with the principles of the present invention.

Referring now to the drawings and, in particular, FIGS. 1, 2 and 3 for a description of one example of the present invention in the form of a game target 10 which is employed in playing the inventive game. The game target 10 comprises an upright support leg or rod 14 which has a lower L-shaped end 15. The game target 10 further comprises a plurality of L-shaped legs 12, each of which has one upright section 13 secured to the bottom of the support rod 14. The support rod 14, in turn, is utilized to support a plurality of circular hoops 16, 18 and 20. Various elements of the present invention may be fabricated from a plurality of materials, such as metal, plastic and the like, and the elements may be connected by any suitable fastener, such as an adhesive or the like. The hoop 16 is the smallest hoop having a 14-inch diameter, while the hoops 18 and 20 are the next larger sizes respectively having diameters of 16 and 18 inches. The hoops 16, 18 and 20 are so carried by the support rod 14 that the hoops are disposed in a common plane 21, as best seen in FIG. 2 of the drawings. The top of hoop 16 is approximately 5½ feet above the playing surface 22, while the bottom of the large hoop 20 is approximately 3 feet above the playing surface. While the game will be described in much greater detail hereinafter, it should suffice at this point to indicate that the disk-shaped projectile 24 illustrated in FIG. 3 of the drawings is used by the participants of the game in such a manner that the disk 24 is propelled through one of the hoops 16, 18 or 20. In the preferred embodiment the hoops 16, 18 and 20 are color-coded; and, preferably, the hoop 16 is colored red, while the hoop 18 is colored white, and the hoop 20 is colored blue. As also will be described hereinafter in greater detail, each of the hoops is provided with a particular point value, which point value is awarded to the player who successfully glides disk 24 through a selected hoop and which disk 24 is caught by the player's partner on the opposite side of the target 10. It is preferred, however, that the smallest hoop 16 have a point value of 3, while the mid-sized hoop 18 have a point value of 2, and the largest hoop 20 have a point value of 1.

Figure 5:
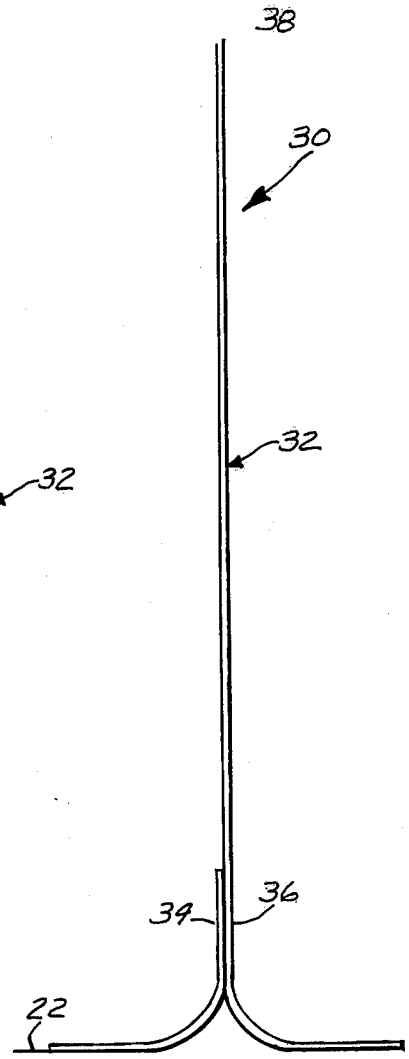
FIG. 5 is a side elevational view of the game target illustrated in FIG. 4.

Referring now to FIGS. 4 and 5 for a description of a second form of applicants' inventive game, there is illustrated a target 30 in the form of a U-shaped, upright support 32 which has its lower ends bent to form L-shaped legs 36. The L-shaped legs 36 are, in turn, attached to L-shaped legs 34 to provide suitable stability to the U-shaped support 32 to keep the same in an upright position. The top 38 of the U-shaped support 32 has a plurality of circular hoops 40, 42 and 44 attached thereto. As in a manner similar to the hoops 16, 18 and 20 described with reference to the embodiment of the invention illustrated in FIG. 1 of the drawings, the hoops 40, 42 and 44 respectively have diameters of 14, 16 and 18 inches so as to provide increasingly more difficult targets as the diameters of the target hoops 40, 42 and 44 decrease in size. In this embodiment of the invention the top of the U-shaped support 32 is approximately 5½ feet above the playing surface 22, and the U-shaped member 32 has a width of approximately 48 inches.

Figure 7:
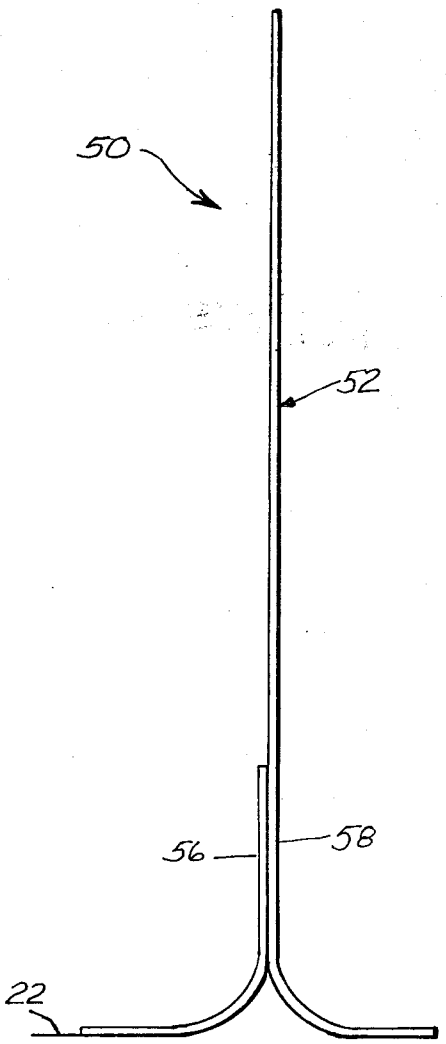
FIG. 7 is a side elevational view of the game target illustrated in FIG. 6.
Figure 6:
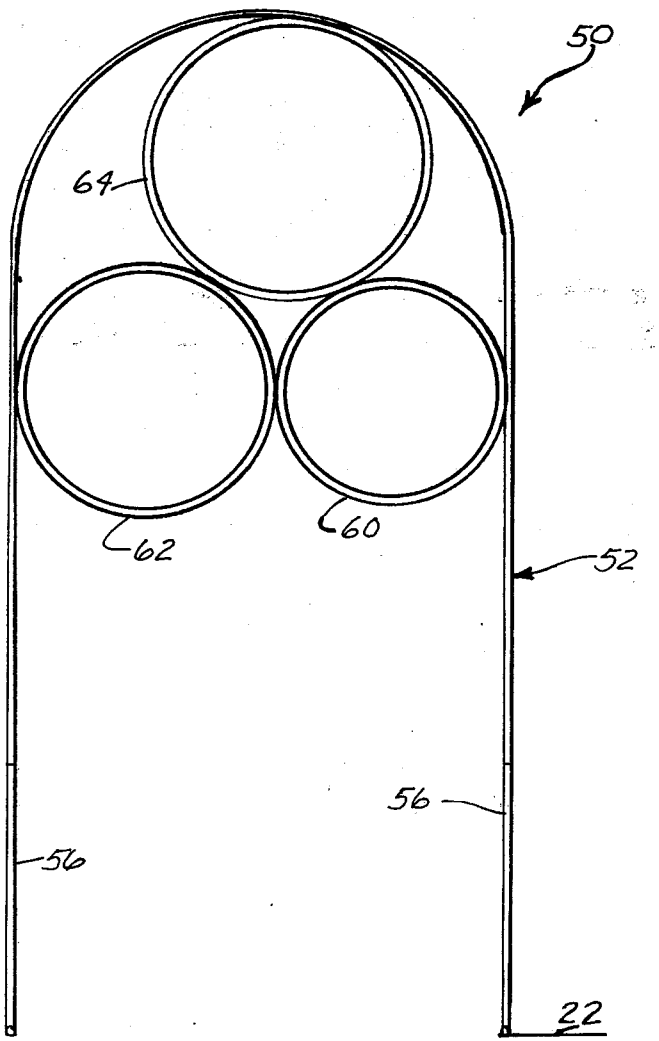
FIG. 6 is a front elevational view of a third embodiment of the present invention in the form of a game target constructed in accordance with the principles of the present invention.

Referring now to FIGS. 6 and 7 of the drawings, there is illustrated a third embodiment of the present invention in the form of a game target 50 which is similar to the game target 30 in that it comprises a U-shaped member 52 having a pair of downwardly extending legs which terminate in bent ends defining L-shaped legs 58. The legs 58 are, in turn, attached to a pair of legs 56. The support legs 56 and 58 support the U-shaped member 52 in an upright position in the manner illustrated in the drawings. The game target 50 further comprises a plurality of varying sized circular target hoops 60, 62 and 64. In a manner similar to the embodiments illustrated in several figures hereinbefore described, the circular hoops 60, 62, and 64 have varying diameters which are respectively and preferably sized at 14, 16 and 18 inches. In the embodiment illustrated in FIG. 6 of the drawings the top of the game target 50 is approximately 70 inches above the playing surface 22, while it has a width of 30 inches.

In the preferred embodiment it is an object of the game that participants score 21 points in order to be declared the winning team. Preferably, a team consists of two players who select a colored disk 24, preferably a red, white or blue colored disk, as their team color. Team players or partners pick up positions on opposite sides of the playing surface, that is, on opposite sides of the target 10, such that each player faces the circular hoops. Points are accorded to a team when one member of a team tosses one of the disk-shaped projectiles 24 through a circular hoop and his team partner catches the disk before it hits the playing surface 22. The amount of points scored varies according to the color of the hoop, that is, the point value accorded a particular circular hoop. The smallest hoop is the most difficult to toss a disk through and, therefore, is accorded 3 points. The middle-sized hoop is accorded 2 points, while the largest hoop is accorded 1 point. In the preferred embodiment the inventive game is played by having the red team commence the play, followed by the white team, and then the blue team. A round of play is considered complete when both members of each team have thrown the disk 24 through a target to his partner who attempts to catch the same. This rule provides an important function of the game because at the finish of the game, each team must be given a chance to complete its round of play in order to be able to achieve a tie in the score of 21 points in the event one of the other teams has achieved that score. In order to win, each team member or partner must pass the disk through each of the colored hoops once for his partner to catch the same. This prevents the continual use of the larger, easier hoops to obtain excessive point values. A team score would be 12 when this rule has been completed. The remaining 9 points may then be made up of any combination of colored hoops.

It is an object of the game that the participants score exactly 21 points. Thus, if a team has a team score of 19 and scores a 3 making their score 22, the 3 is subtracted from the 19 leaving them with a score of 16. Thus, the team is penalized if it should score more than 21 points.

In the event of a tie, that is, two teams completing rounds with a score of 21, the first team to reach 6 points by successfully passing the disk 24 through each colored hoop is declared the winner. It should be noted that the disk may hit the inside of a hoop as long as it passes through the hoop and is successfully caught by the partner. In the event only two persons play the game, the rules as described above are the same except that the object is to make your opponent miss catching the disk. Thus, if an opponent catches the disk, then the opponent is accorded the point value of that particular colored hoop. If the opponent misses the disk, then the party tossing the disk is awarded the point count associated with the particular hoop.

It can thus be seen that the present game provides a new and improved disk projectile target, and it should be understood by those skilled in the art of games that other forms of applicants' invention may be had, all coming within the spirit of the invention and scope of the appended claims.

What is claimed is as follows:

1. A game for at least two players, said game comprising:

a support;

at least three circular hoops secured to said support and fixedly disposed in a common plane, at least two hoops abutting at least one other hoop and the support member, said hoops having different diameters to provide targets in the form of circular hoops of varying areas, each hoop having a certain point value, the point value decreasing as the area of the hoop increases;

said support defining means for elevating said hoops above a playing surface and for disposing said hoops between said players; and a disc shaped projectile adapted to be manually tossed by one player so as to glide through one of said hoops and be caught by the other of said players, the amount of points awarded a player being dependant upon the hoop through which said disc glides.

2. The game defined in claim 1 wherein said hoops are color coded, each color being representative of a particular point value.

3. The game defined in claim 1 wherein said elevating means comprises:

a U-shaped support member having a pair of downwardly depending legs connected by an upper base section; and a pair of laterally spaced, L-shaped legs carried by and supporting said U-shaped, upright legs so as to support said member in an upright position, said hoops being carried on the inside surface of said U-shaped member in a side-by-side relationship.

4. The game defined in claim 1 wherein said elevating means comprises:

a support rod disposed in a vertical position; and a plurality of L-shaped members secured to the bottom of said upright rod to support said upright rod in said upright position, said plurality of hoops being carried at the upper end of said rod in a circular path about said rod end.

5. The game defined in claim 1 wherein said elevating means comprises:

a U-shaped member having a circular base and a pair of downwardly depending legs;

a pair of L-shaped members attached to each of said legs for supporting said U-shaped member in said upright position; and a plurality of said hoops being disposed in the inside of said U-shaped member and attached thereto, each of said hoops being in abutment with the other of said hoops.

* * * * *